US009702614B2

(12) United States Patent
Lim

(10) Patent No.: US 9,702,614 B2
(45) Date of Patent: Jul. 11, 2017

(54) REFRIGERATOR

(71) Applicant: LG ELECTRONICS INC., Seoul (KR)

(72) Inventor: Kiyoung Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/061,001

(22) Filed: Mar. 4, 2016

(65) Prior Publication Data

US 2016/0305706 A1 Oct. 20, 2016

(30) Foreign Application Priority Data

Apr. 14, 2015 (KR) ..... 10-2015-0052740

(51) Int. Cl.

| | |
|---|---|
| ***F25D 23/00*** | (2006.01) |
| ***F25D 23/04*** | (2006.01) |
| ***F25D 23/02*** | (2006.01) |
| *F25D 23/06* | (2006.01) |

(52) U.S. Cl.

CPC ..... *F25D 23/04* (2013.01); *F25D 23/025* (2013.01); *F25D 23/067* (2013.01)

(58) Field of Classification Search

CPC ..... A47B 96/02; A47B 96/024; A47B 96/027; A47B 96/028; A47B 96/061; A47B 96/066; A47B 96/068; F25D 23/028; F25D 23/04; F25D 23/02; F25D 23/025; F25D 29/005

USPC ..... 211/75, 90.01, 106, 119.004; 312/405, 312/321.5, 405.1, 404, 408; 108/108; 248/220.21, 220.22, 224.8, 225.21

See application file for complete search history.

(56) References Cited

U.S. PATENT DOCUMENTS

| | | | | |
|---|---|---|---|---|
| 7,300,120 | B2 * | 11/2007 | Shin | F25D 23/04 108/108 |
| 9,400,132 | B2 * | 7/2016 | Shrader | F25D 23/02 |
| 9,435,579 | B1 * | 9/2016 | House | F25D 23/028 |
| 2006/0248824 | A1 * | 11/2006 | Cho | F25D 23/02 52/205 |
| 2008/0203874 | A1 * | 8/2008 | Lim | E05D 11/0054 312/404 |
| 2009/0039749 | A1 * | 2/2009 | Gerstner | F25D 23/04 312/404 |
| 2014/0360220 | A1 * | 12/2014 | Rackley | F25D 23/028 62/377 |

(Continued)

FOREIGN PATENT DOCUMENTS

| | | |
|---|---|---|
| JP | H06-213559 | 8/1994 |
| KR | 20-1999-0021545 | 6/1999 |

(Continued)

*Primary Examiner* — Janet M Wilkens
(74) *Attorney, Agent, or Firm* — KED & Associates, LLP

(57) ABSTRACT

A refrigerator is provided. The refrigerator may include a cabinet having a storage compartment, a door pivotably mounted to the cabinet to open or close the storage compartment, and the door may include a first door defining a front surface of the door, a door liner coupled to a rear surface of the first door, a basket holder mounted in a mounting recess provided in the door liner, the basket holder having a protrusion that protrudes out from the mounting recess, and a rear panel attached to a rear surface of the door liner, the rear panel having a through-hole configured to allow passage of the protrusion, and a basket mounted to the protrusion of the basket holder.

19 Claims, 11 Drawing Sheets

(56) References Cited

U.S. PATENT DOCUMENTS

2016/0123655 A1* 5/2016 Chow ..... F25D 23/04
312/404

FOREIGN PATENT DOCUMENTS

| | | | |
|---|---|---|---|
| KR | 20-142486 | | 6/1999 |
| KR | 20020068929 | * | 8/2002 |
| KR | 10-2011-0072435 | | 6/2011 |
| WO | 2016023091 | * | 2/2016 |

* cited by examiner

REFRIGERATOR

CROSS-REFERENCE TO RELATED APPLICATION

This application claims priority under 35 U.S.C. §119 to Korean Application No. 10-2015-0052740 filed on Apr. 14, 2015, whose entire disclosure is incorporated herein by reference.

BACKGROUND

1. Field

Embodiments relate to a refrigerator.

2. Background

A refrigerator is an apparatus in which cold air, generated via a refrigeration cycle including, for example, a compressor, a condenser, an expansion valve, and an evaporator, is supplied into a storage compartment to keep food stored in the storage compartment. The storage compartment may be a freezing compartment, in which foods or beverages are kept frozen, and a refrigerating compartment, in which foods or beverages are kept cold.

Refrigerators may be divided, based on an arrangement of the freezing compartment and the refrigerating compartment, into a top mounting type refrigerator, in which a freezing compartment is located above a refrigerating compartment, a bottom freezer type refrigerator, in which a freezing compartment is located below a refrigerating compartment, and a side by side type refrigerator, in which a freezing compartment and a refrigerating compartment are divided into left and right sides.

Functions of refrigerators have diversified from keeping food at a subzero temperature or at a temperature slightly above freezing. For example, a dispenser may be installed in a refrigerator door to provide purified water and ice, and a display may be installed on the front surface of a door so as to show a state of the refrigerator and enable the control thereof.

Large refrigerators with large storage capacities have been released, and in order to efficiently utilize a receiving space, door shelves and receiving cases may be provided inside a refrigerating compartment door to define a space to place items. A receiving case, which may be a space provided inside a door, separately from a storage compartment, may be referred to as a home bar or an auxiliary storage compartment.

In order to enable access to the auxiliary storage compartment without opening the door to the entire refrigerating compartment, a refrigerating compartment door may be provided with an opening, and a sub door may be mounted to open or close the opening. The door to open or close an interior of the refrigerating compartment may be called a main door, and the door to open or close the auxiliary storage compartment door may be called a sub door.

The sub door may have a same size as the main door so as to overlap the main door or may be smaller than the main door so as to be pivotably mounted inside the opening of the main door. The sub door may be mounted so as to be pivotable upward and downward about a horizontal axis, or may be mounted so as to be pivotable leftward or rightward about a vertical axis. When the sub door is mounted so as to be pivotable leftward or rightward, a basket may also be mounted to a rear surface of the sub door in order to utilize a space between the sub door and the opening of the main door.

In a general configuration of a door of a refrigerator, an outer door defining a front surface of the door and a door liner defining a rear surface of the door are coupled to each other, and an insulation material is provided in the space therebetween. In the refrigerator, a door dike is integrally formed with the door liner to enable a basket to be mounted. As the door liner is formed of a synthetic resin, the door dike may be integrally formed with the door liner by injection molding. However, the door dike protrudes to occupy storage space in the basket and in the refrigerator. In addition, if a panel formed of a different material, for example, a steel panel, is attached to the rear surface of the door liner of the sub door, it is difficult to form a basket mounting structure, such as the door dike, in such a panel.

BRIEF DESCRIPTION OF THE DRAWINGS

The embodiments will be described in detail with reference to the following drawings in which like reference numerals refer to like elements wherein.

DETAILED DESCRIPTION

Figure 1:
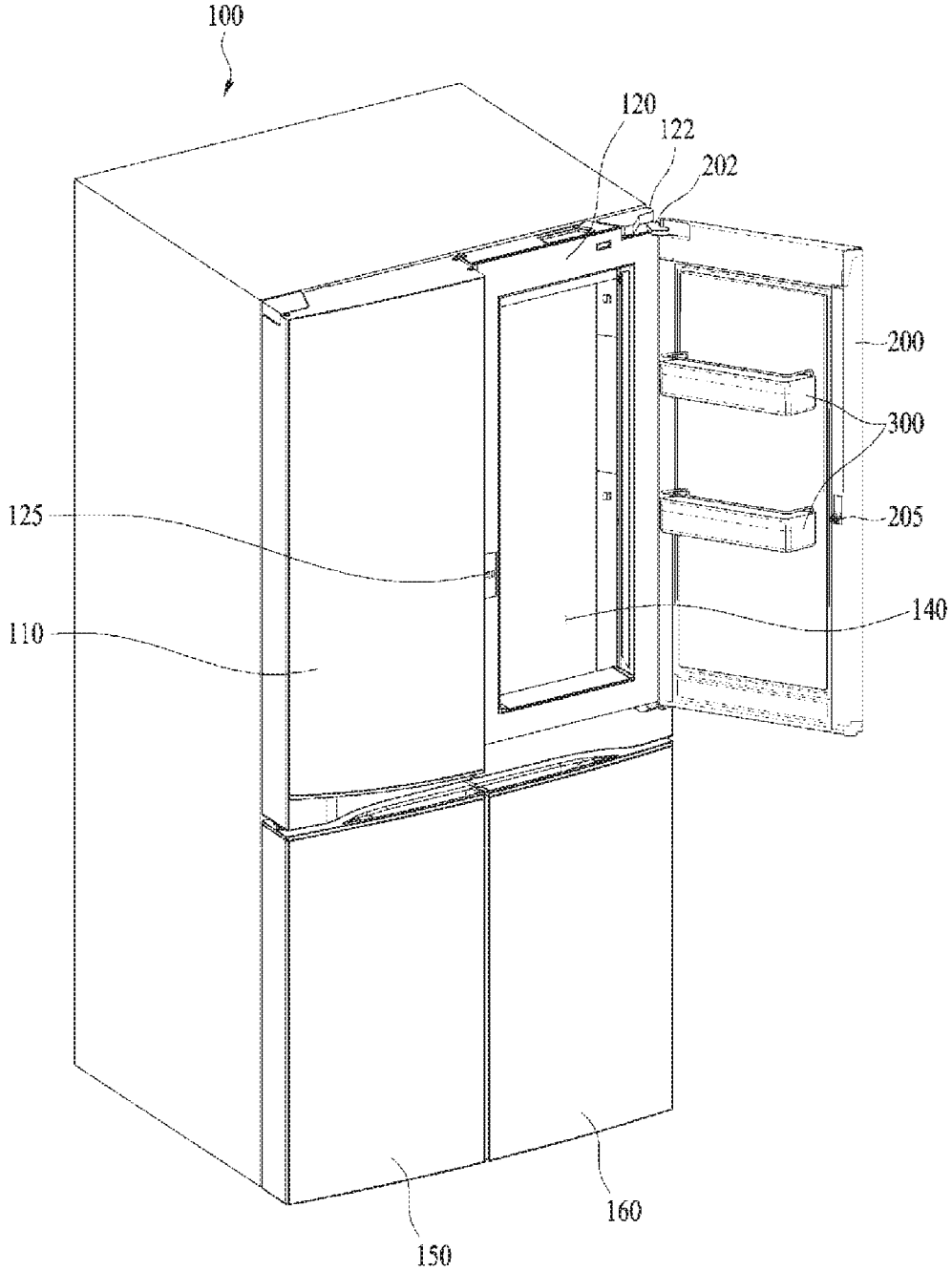
FIG. 1 is a perspective view illustrating a refrigerator according to an embodiment.

As illustrated in FIG. 1, doors to open or close the refrigerating compartment may include a left or first refrigerating compartment door 110 and a right or second refrigerating compartment door and may be pivotably mounted. Similarly, doors to open or close the freezing compartment may include a left or first freezing compartment door 150 and a right or second freezing compartment door 160. A door may be pivotably mounted as a door for the freezing compartment, or a drawer type door may be mounted so as to be pulled forward or pushed rearward as the door for the freezing compartment.

The second refrigerating compartment door may include a main door 120 to open or close the refrigerating compartment at a right side and a sub door 200 pivotably mounted to the main door 120. The refrigerating compartment door may include a main door and a sub door, and the main door and the sub door may have a width corresponding to a width of the cabinet 100, rather than being divided into left and right or first and second parts, and may be pivotably mounted. Although a case where a basket 300 is mounted to the sub door 200 may be described hereinafter, embodiments disclosed herein may also be applied to a case where a basket may be mounted to a rear surface of a single pivotable door, such as the first freezing compartment 150.

The main door 120 may be pivotably mounted to the cabinet 100 by a hinge 122, and the sub door 200 may be pivotably mounted to the main door 120 by a hinge 202. The main door 120 may be centrally provided with an opening 140, and an auxiliary storage compartment may be defined in a rear side of the main door 120. The sub door 130 may be configured to open or close the auxiliary storage compartment.

The auxiliary storage compartment may be a storage space divided from an interior space of the refrigerating compartment. One or more baskets may be mounted in the auxiliary storage compartment. In addition, a plurality of baskets may be vertically arranged in the auxiliary storage compartment, and a rear wall may be provided at a rear of the auxiliary storage compartment. Access to the auxiliary storage compartment may be permitted through the opening 140 when the sub door 200 is opened.

Figure 2:
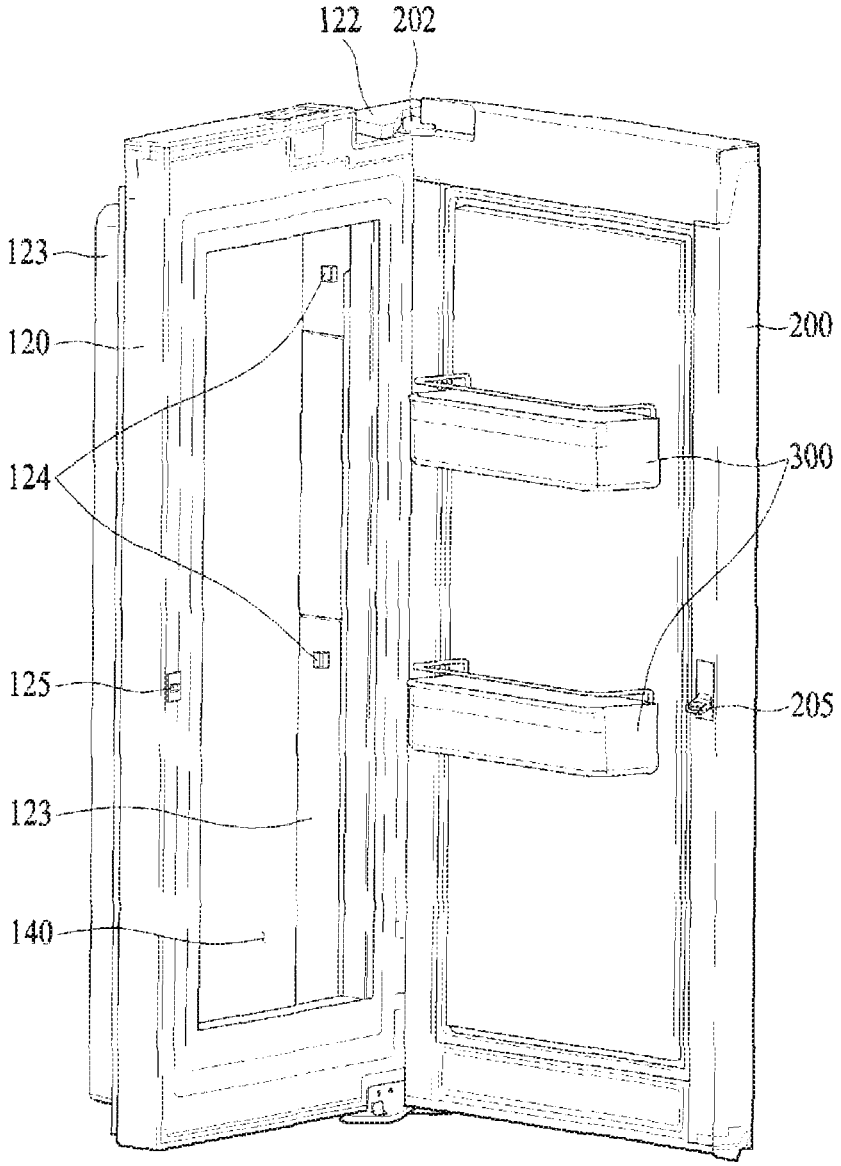
FIG. 2 is a perspective view illustrating a main door and a sub door of the refrigerator of FIG. 1.

As illustrated in FIG. 2, a plurality of basket hangers 124 may protrude from an inner side surface of a door dike 123 of the main door 120 so that the plurality of baskets may be mounted to the basket hangers 124. A hook 205 may be mounted at a side of a rear surface of the sub door 200 and may be configured so as to be inserted into a latch recess 125 formed in a side of a front surface of the main door 120. The hook 205 may be pivoted upward or downward at a prescribed or predetermined angle in a mechanical or electronic manner so as to be caught by or released from the latch recess 125. Alternatively, the hook 205 may be immovably secured to the sub door 200, and a latch configured to be operated by a user may be provided inside a latch device.

When the user pulls the sub door 200 in a state in which the hook 205 is caught by the latch recess 125, the main door 120 and the sub door 200 may be pivoted while being coupled to each other. When the user releases the hook 205 from the latch recess 125 and then pulls the sub door 200, the sub door 200 may be pivoted to allow the user to access the auxiliary storage compartment.

At least one basket 300 may be separably mounted to the rear surface of the sub door 200. In FIGS. 1 and 2, two baskets 300 are vertically arranged on the rear surface of the sub door 200. One or more baskets may be mounted on the rear surface of the sub door 200. In order to mount the basket 300, the sub door 200 may be provided with basket holders protruding from the rear surface thereof. The sub door 200 may not be provided with the door dike 123 formed at the rear surface of the main door 120. The basket holders may protrude from the rear surface of the sub door 200, and may be mounted so as not to be seen once the basket has been mounted.

Figure 3:
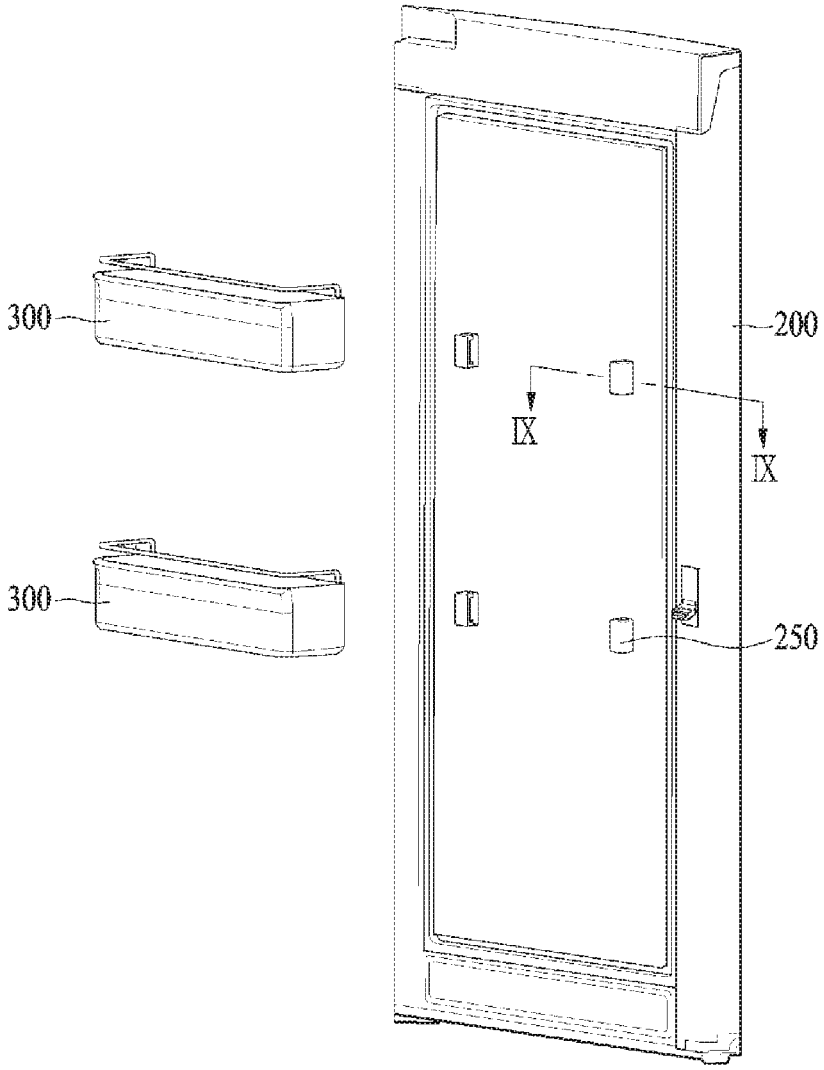
FIG. 3 is an exploded perspective view illustrating the sub door of FIG. 2.
Figure 4:
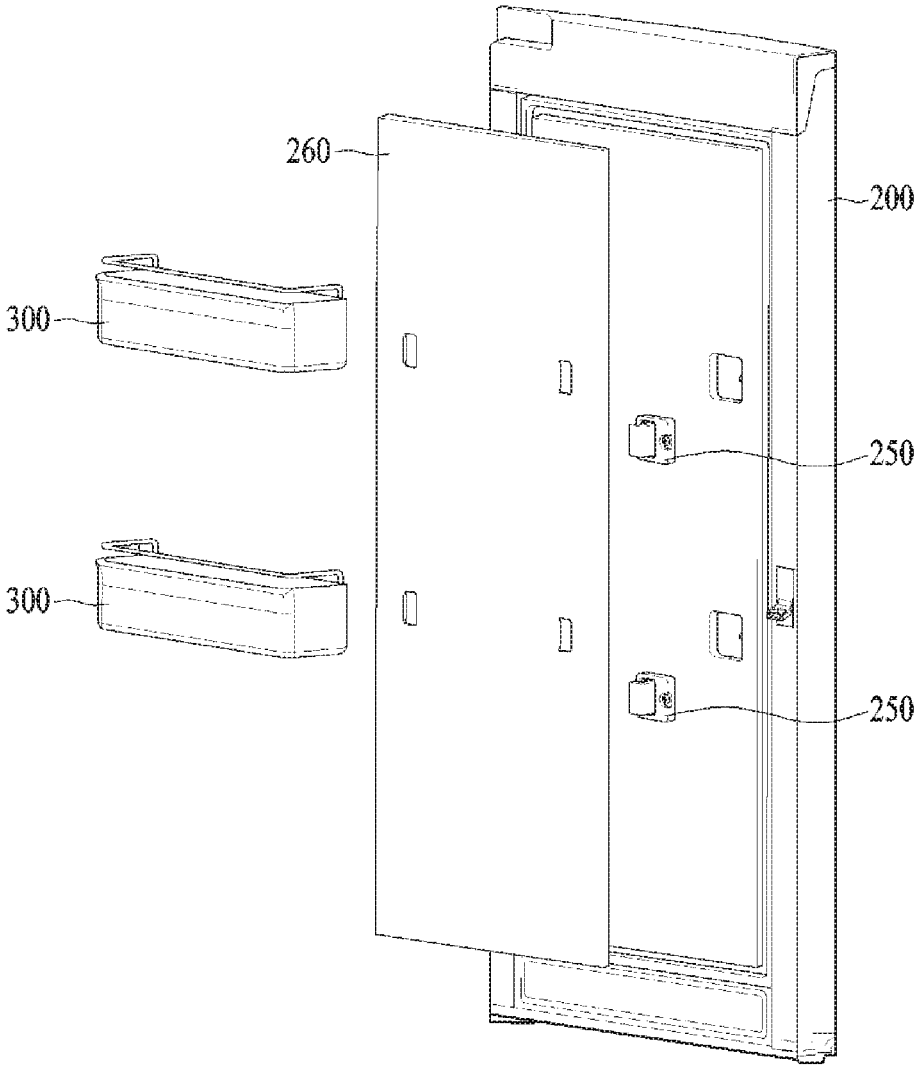
FIG. 4 is an exploded perspective view illustrating a rear panel of the sub door of FIG. 3.
Figure 5:
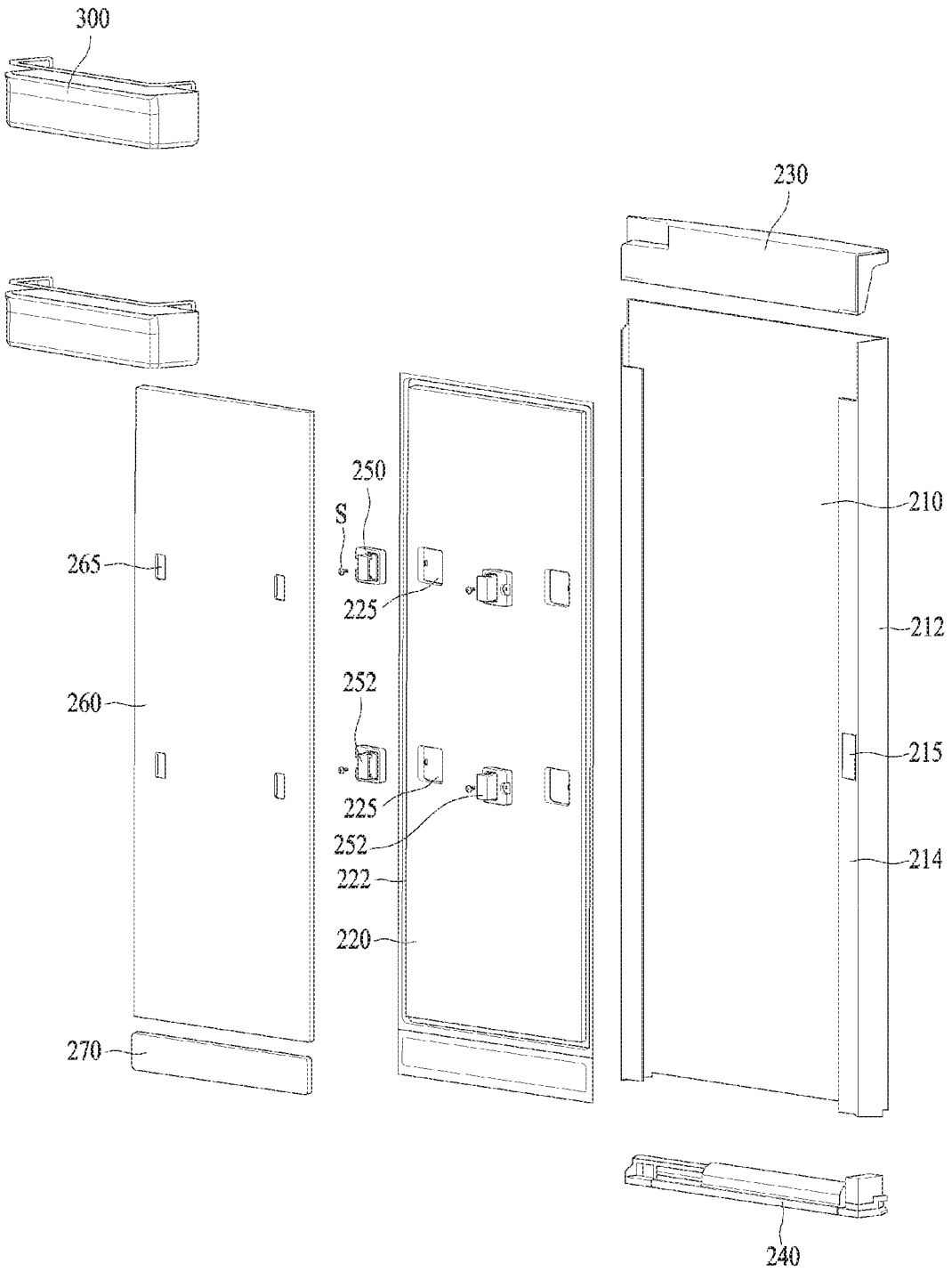
FIG. 5 is an exploded perspective view illustrating the rear panel, a door liner, and an outer door of FIG. 4.

As illustrated in FIGS. 3 and 4, the basket 300 may be separably mounted to a pair of basket holders 250, which may be mounted at opposite sides of the rear surface of the sub door 200. As illustrated in FIG. 5, the sub door 200 may include an outer door 210 defining a front surface thereof and a door liner 220 coupled to a rear surface of the outer door 210. The outer door 210 may include a front surface portion (a front surface), side surface portions (side surfaces) 212, which may extend rearward from opposite ends of the front surface portion, and bent portions (bent edges) 214, which may be bent leftward or rightward from the respective side surface portions 212 so as to extend by a prescribed or predetermined length. A hook mounting hole 215 may be provided at one of the bent portions 214 for mounting the hook 205 in the sub door 200.

The door liner 220 may include a flat plate, and opposite ends of the door liner 220 may be coupled to the bent portions 214. The door liner 220 may define the rear surface of the sub door 200 and may be manufactured by molding a synthetic resin. The outer door 210 may also be manufactured via metal sheet working.

Once the outer door 210 and the door liner 220 have been coupled to each other so as to define a cuboid having open top and bottom sides, an upper decorative member or cover 230 may be coupled to the top side and a lower decorative member or trim 240 may be coupled to the bottom side. An insulation material 290, for example, polyurethane foam, may be injected into a space hermetically sealed by the outer door 210, the door liner 220, the upper cover 230, and the lower cover 240.

Figure 6A:
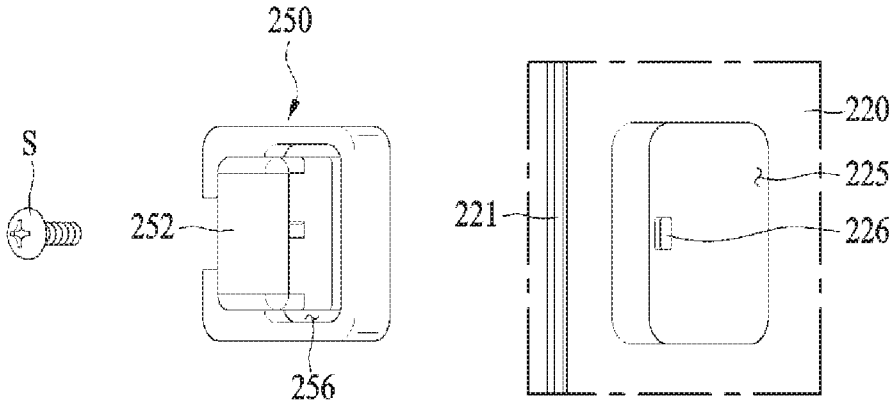
FIGS. 6A and 6B are exploded perspective views illustrating mounting a holder into a mounting recess of the door liner.
Figure 7A:
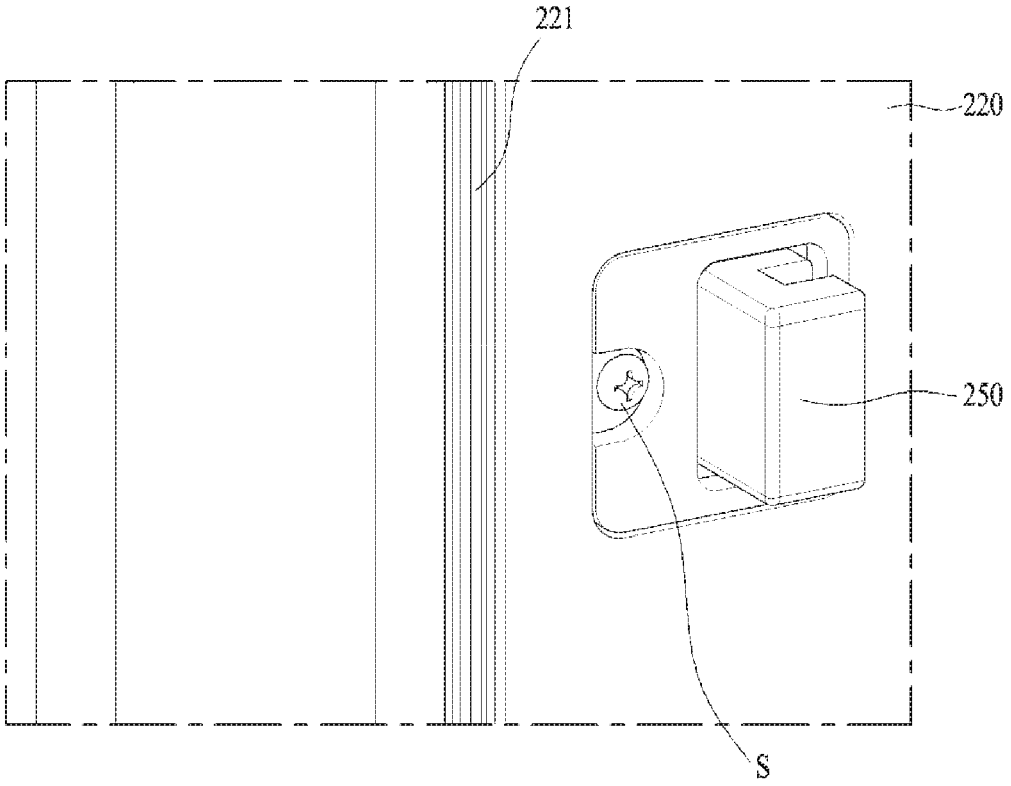
FIG. 7A is a perspective view illustrating the holder mounted in the mounting recess of the door liner.

In addition, a gasket 222 may be mounted to an edge of the door liner 220. The gasket 222 may come into close contact with the front surface of the main door 120 when the sub door 200 is closed, thereby preventing leakage of cold air. As illustrated in FIGS. 6A and 7A, a gasket mounting groove 221 may be formed in an edge of a rear surface of the door liner 220, and a mounting rib formed at the gasket 222 may be inserted into the gasket mounting groove 221.

Figure 6B:
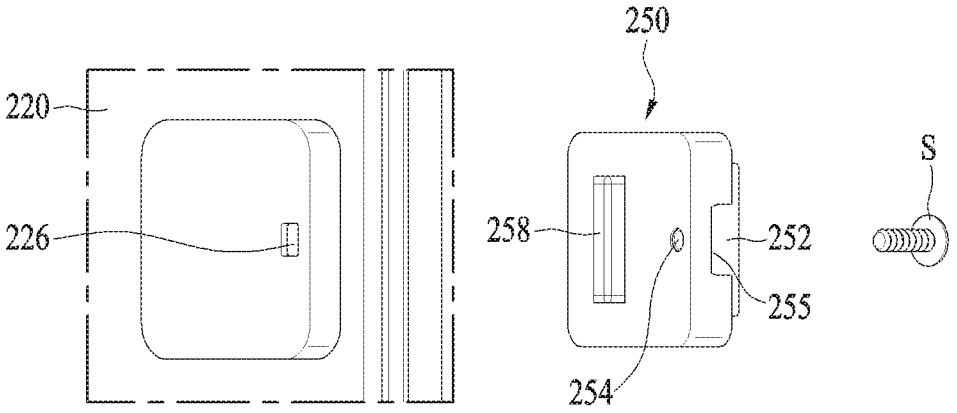

The door liner 220 may be provided with a plurality of mounting recesses 225, into which the basket holders 250 may be inserted and fastened using screws S, respectively. As illustrated in FIGS. 6A and 6B, the basket holder 250 may be provided with a protrusion 252 configured to protrude rearward. A remaining portion of the basket holder 250 excluding the protrusion 252 may be inserted into the mounting recess 225 so as to be fastened and secured using the screw S.

At least one pair of mounting recesses 225 may be provided at a prescribed or predetermined height near opposite edges of the rear surface of the door liner 220. The mounting recesses 225 may be rectangular recesses that correspond to the rectangular basket holders 250. Each of the mounting recesses 225 may be provided with a through-hole 226 for the fastening of the screw S.

When a pair of basket holders 250 is mounted, the protrusions 252 of the basket holders 250 may be configured such that ends thereof facing each other may be bent inward. That is, as illustrated in FIG. 5, the protrusion 252 of the basket holder 250 mounted at the left side may be bent rightward, and the protrusion 252 of the basket holder 250 mounted at the right side may be bent leftward.

In addition, as illustrated in FIG. 6B, the basket holder 250 may be formed with a fastening hole 254 for the fastening of the screw S. The fastening hole 254 may be provided at a side of the protrusion 252 opposite to a direction in which the protrusion 252 may be bent. To correspond to a position of the fastening hole 254, the through-hole 226 formed in the left mounting recess 225 may be deviated leftward, and the through-hole 226 formed in the right mounting recess 225 may be deviated rightward.

Figure 10A:
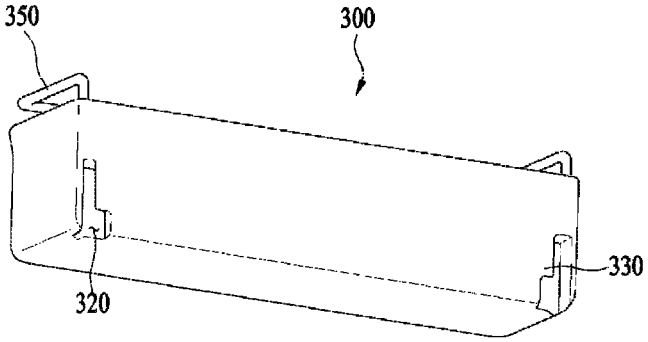
FIGS. 10A and 10B are perspective views illustrating a basket.
Figure 10B:
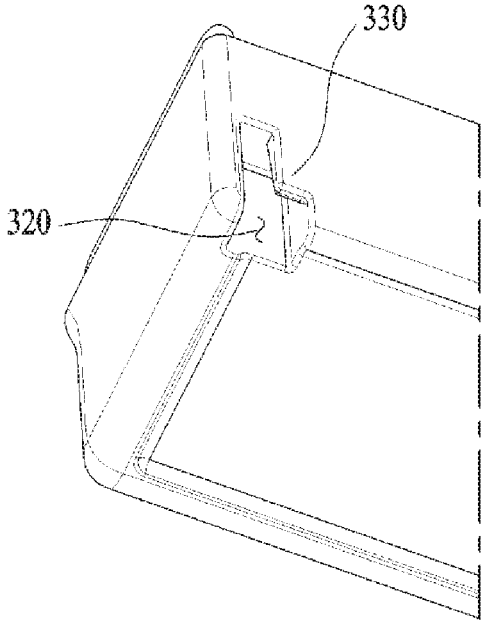

In addition, a surface of the basket holder 250, formed with the fastening hole 254, may be provided with a receiving recess 255 to receive the head of the screw S therein. When the basket holder 250 is mounted in the mounting recess 225, the receiving recess 255 may prevent the head of the screw 5, excluding the protrusion 252, from protruding from the rear surface of the door liner 220. Referring to FIGS. 10A and 10B, the basket 300 may be provided in the rear surface thereof with insertion recesses 320 into which the protrusions 252 may be inserted.

A rear panel 260 may be attached to the rear surface of the door liner 220. As illustrated in FIG. 5, the rear panel 260 may be a rectangular panel that corresponds to an inner shape of the gasket 222 and may be formed with a plurality of through-holes 265, through which the protrusions 252 of the respective basket holders 250 may pass. The rear panel 260 may be a thin panel and may be formed of a different material from that of the door liner 220. For example, the rear panel 260 may be a plated steel panel. When attached to the door liner 220, the rear panel 260 may be a steel panel, at least a rear surface of which may be plated, or all surfaces of which may be plated. The rear panel 260 may be an exterior material defining the rear surface of the sub door 200, and may provide a different tactile sensation from the door liner 220 when the user opens the sub door 200. In addition, a lower portion of the door liner 220 may extend further downward than a lower end of the gasket 222, and a lower rear panel 270 may be attached to a rear surface of a resulting downward extension.

Figure 7B:
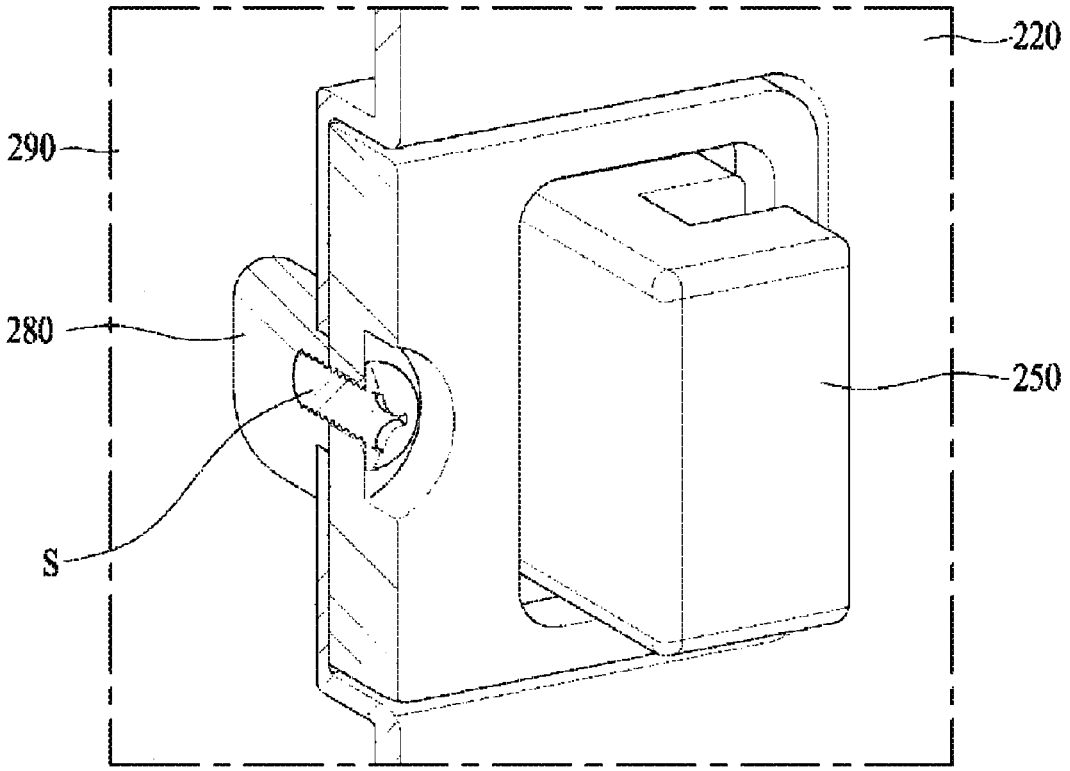
FIG. 7B is a partial cutaway perspective view of FIG. 7A.

As illustrated in FIG. 7B, the door liner 220 may further include a bush 280, which is provided on the rear surface of the door liner 220 and may be fastened with the screw S that has passed through the fastening hole 254 of the basket holder 250 and the through-hole 226 formed in the mounting recess 225.

The door liner 220 may be relatively thin. When the screw S passes through the fastening hole 254 of the basket holder 250 and is fastened only to the door liner 220, a resulting fastening force may be small. The bush 280 may be sufficiently thick to allow about a half length of the screw S to be inserted and fastened therein. After the basket holder 250 is fixed as the screw S is fastened in the state in which the bush 280 is in contact with the inner surface of the door liner 220, an insulation material 290 may be injected into a space between the outer door 210 and the door liner 220 and then may be foamed and hardened.

The bush 280 may be buried in the insulation material 290, which may ensure stronger fixing of the basket holder 250. Accordingly, even if a heavy item is accommodated in the basket 300, the basket holder 250 may sufficiently support the basket 300 and a problem, such as, for example, deformation of the door liner 220, may be prevented.

Figure 8:
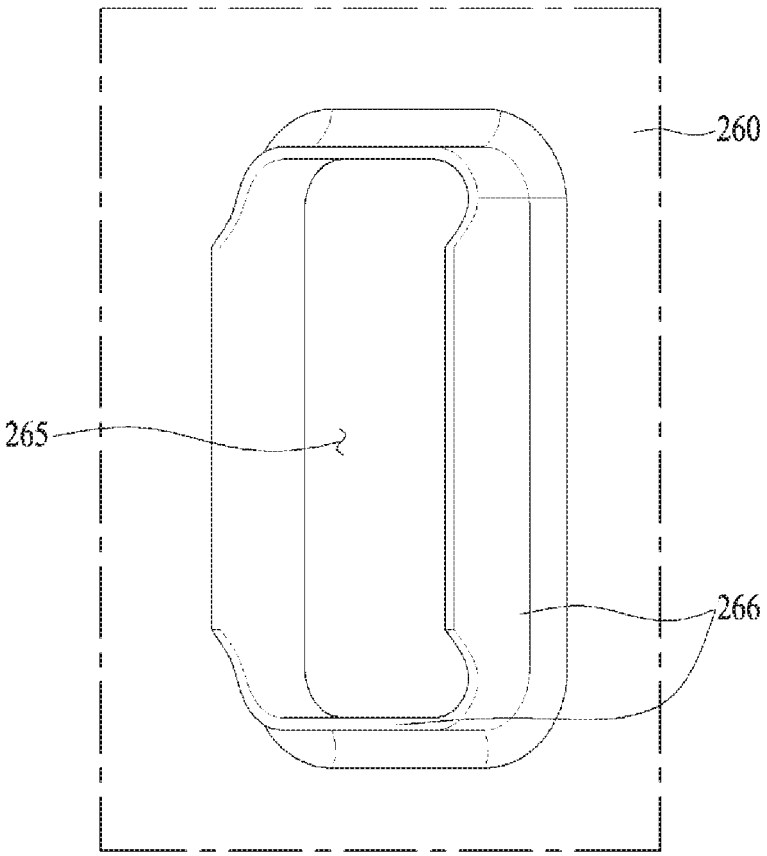
FIG. 8 is a partial perspective view illustrating a through-hole of the rear panel viewed from a rear side.

FIG. 8 is a partial perspective view illustrating the through-hole 265 of the rear panel 260 viewed from a rear side. As illustrated in FIG. 8, the rear panel 260 may include bent portions 266 extending rearward from a rim of the through-hole 265. The through-hole 265 may have a rectangular shape, and the bent portions 266 may extend rearward from respective four sides of the rectangular through-hole so that corners of the respective extensions may be connected to neighboring extensions.

As described above, the rear panel 260 may be a plated steel panel. When the through-hole 265 is formed in the plated steel panel by punching, a cut surface of the plated steel panel may be exposed to the rear surface of the sub door 200 because the cut surface is not plated and susceptible to rust. Thus, as the bent portions 266 protrude rearward, for example, toward the door liner 220 from the rim of the through-hole 265 of the rear panel 260, it may be possible to prevent the cut surface of the through-hole 265 from being exposed outward when the sub door 200 is assembled.

In addition, as illustrated in FIG. 6A, the basket holder 250 may be provided at a front surface thereof with a receiving groove 256 around the protrusion 252. The bent portions 266 of the rear panel 260 may be inserted into the receiving groove 256. The receiving groove 256 may have a sufficient width and depth so as to allow the bent portions 266 to be completely inserted therein without risk of interference therebetween. As illustrated in FIG. 6B, the basket holder 250 may be provided at a rear surface thereof with a rear recess 258 corresponding to the protrusion 252 for reducing material.

Figure 9:
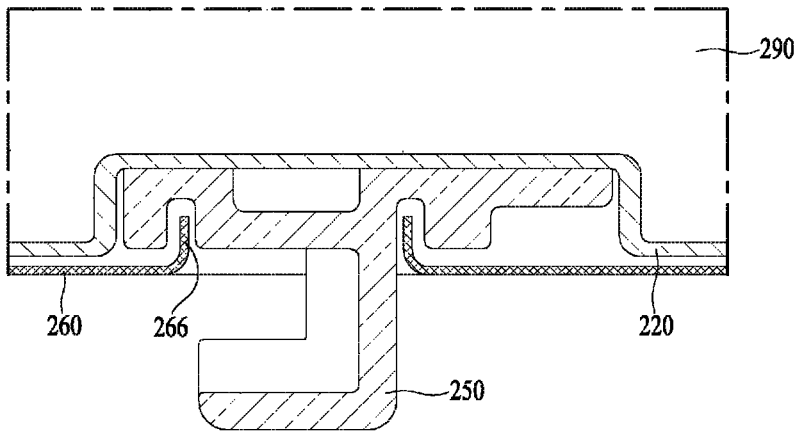
FIG. 9 is a partial sectional view horizontally taken along line IX-IX of FIG. 3.

As illustrated in FIGS. 8 and 9, even if a rear surface of the bent portion 266 is cut to expose a cross section having no plating, a rear cross section of the bent portion 266 may be inserted into the receiving groove 256 and may be completely unexposed, which may prevent the rear cross section from becoming rusted and the external appearance from deteriorating. As a periphery of the bent portions 266 of the rear panel 260 covers the basket holder 250 excluding the protrusion 252, a region at which the basket holder 250 may be mounted may have a tidy external appearance.

As illustrated in FIGS. 10A and 10B, the basket 300 may be provided at opposite sides of a lower portion of the rear surface thereof with a pair of insertion recesses 320, into which the protrusions 252 may be inserted. As the insertion recesses 320 are formed in a lower half portion of the basket 300 at opposite sides of the rear surface thereof, storage space inside the basket 300 may be increased compared to when the insertion recesses 320 are formed in an upper half portion of the basket 300.

The protrusions 252 of the two basket holders 250, mounted to face each other, may be inserted into the insertion recesses 320, respectively. Each of the insertion recesses 320 may include a cover portion 330 formed to prevent the protrusion 252 inserted into the insertion recess 320 from being separated therefrom in a horizontal direction. The cover portion 330 may have a small rectangular shape and may be integrally formed to cover a right upper portion of a rear surface of the insertion recess 320 when the rear surface of the insertion recess 320 has a vertically elongated rectangular shape.

The basket 300 may be formed by injection molding a synthetic resin. The basket 300 may be injection-molded such that the insertion recesses 320, each having the cover portion 330, may be formed at opposite sides simultaneously with a formation of a concave region defining a storage space in the basket 300. This is because the storage space in the basket 300 may be open upwards and the insertion recess 320 may be open downwards, and thus, a stereoscopic shape of the basket 300 may be formed using a pair of molds that open in opposite directions.

A support wire or support 350 may be provided at an upper end of the basket 300 and may be configured as a thick metal wire. When a vertically elongated item such as a bottle is accommodated in the basket 300, the support 350 may support the item so as to prevent the item from tilting. In addition, when the basket 300 is mounted or separated, the support 350 may be used as a grip to hold the basket 300.

The basket 300 may have a thick portion above the insertion recesses 320, and both ends of the support 350 may be inserted into and mounted in holes formed in the thick portion. The support 350 may be located along a rim of the upper surface of the basket 300. For example, the support 350 may be spaced apart from a front wall and opposite sidewalls of the basket 30 by a prescribed or predetermined distance.

As illustrated in FIG. 3, only the protrusions 252 protrude from the rear panel 260 defining the rear surface of the sub door 200. When the user pushes the basket 300, which may be in contact with the rear panel 260, downward so that the protrusions 252 may be inserted into the insertion recesses 320 of the basket 300, the basket 300 may be mounted to the basket holders 250.

According to embodiments disclosed herein, in a refrigerator where a rear panel formed of a different material from that of a door liner of a sub door is attached to the door liner, a basket may be firmly mounted to basket holders without forming a door dike at the sub door and may have a tidy outer appearance.

In addition, as the basket holders, provided on the sub door to mount the basket, are mounted to and firmly supported by a door liner rather than to the panel, and protrude rearward through the panel, a weight of the basket may be applied only to the door liner, and there may be no damage to the panel attached to the door liner. As no door dike is formed at the sub door, storage space in the basket may be more efficiently utilized than if a door dike is formed. As a cut cross section of a through-hole formed in the panel is not exposed outward from the rear surface of the panel even when a plated steel panel is used, it may be possible to prevent the cut cross section of the panel from becoming rusty. A screw used to fix the basket holder may not only be fastened to the door liner having a prescribed thickness, but may also be fastened to a bush provided at the rear surface of the door liner, and thereafter an insulation material may be provided between the door liner and an outer door, which may ensure very strong fastening of the holder.

Embodiments disclosed herein provide a refrigerator which may include a structure that may make it possible to mount a basket to a sub door without forming a door dike in the case where a panel, formed of a different material from that of a door liner of a sub door, may be attached to the rear surface of the door liner.

According to embodiments disclosed herein, a refrigerator may include a cabinet having a storage compartment therein, a door pivotably mounted to the cabinet so as to open or close the storage compartment, and a basket separably mounted to a rear surface of the door, wherein the door includes an outer door defining a front surface of the door, a door liner coupled to a rear end of the outer door, a basket holder inserted into and mounted in a mounting recess provided in the door liner, the basket holder being provided with a rearwardly extending protrusion so that the basket is mounted to the protrusion, and a rear panel attached to a rear surface of the door liner, the rear panel having a through-hole for passage of the protrusion.

According to embodiments disclosed herein, a refrigerator may include a cabinet having a storage compartment, a door pivotably mounted to the cabinet to open or close the storage compartment, wherein the door may include a first door defining a front surface of the door, a door liner coupled to a rear surface of the first door, a basket holder mounted in a mounting recess provided in the door liner, the basket holder having a protrusion that protrudes out from the mounting recess, and a rear panel attached to a rear surface of the door liner, the rear panel having a through-hole configured to allow passage of the protrusion, and a basket mounted to the protrusion of the basket holder.

The basket holder may include a pair of basket holders fastened into a pair of mounting recesses, provided near opposite edges of the rear surface of the door liner, by screws. The basket may be provided in opposite sides of a lower portion of a rear surface thereof with a pair of insertion recesses for insertion of the protrusions of the respective basket holders. Each protrusion may have an inwardly bent shape at a distal end thereof. Each of the insertion recesses may include a cover portion formed to prevent the protrusion inserted therein from being separated in the horizontal direction.

The basket may further include a support wire or support having both ends inserted into and mounted in a pair of holes formed in upper corners of the insertion recesses, the support wire being located along a rim of an upper surface of the basket.

The rear panel may include a bent portion extending rearward from a rim of the through-hole. The rear panel may be a plated steel panel. The basket holder may have a receiving groove formed in a front surface thereof around the protrusion, the bent portion being inserted into the receiving groove. The door liner may further include a gasket at the rear surface thereof, the gasket being mounted in a gasket mounting groove formed along an outer side of a rim portion of the rear panel. The door liner may further include a bush provided on the rear surface thereof, the bush being fastened with a screw having passed through a fastening hole of the basket holder and a through-hole formed in the mounting recess. An insulation material may be provided in a space between the door liner and the outer door after the basket holder is coupled to the bush via fastening of the screw.

Embodiments disclosed herein are not limited to this type of refrigerator and may be applied to other refrigerators so long as the refrigerator includes a door, which may be pivoted to open or close the storage compartment, a rear panel, such as, for example, an exterior material mounted to a rear surface of the door, and a basket mounted on the rear surface of the door.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage compartment;

a door pivotably mounted to the cabinet to open or close the storage compartment, wherein the door includes:

an outer door defining a front surface of the door, a door liner coupled to a rear surface of the outer door, a basket holder mounted in a mounting recess provided in the door liner, the basket holder having a protrusion that protrudes out from the mounting recess, and a rear panel attached to a rear surface of the door liner, the rear panel having a through-hole configured to allow passage of the protrusion; and a basket mounted to the protrusion of the basket holder, wherein the door liner further includes a gasket provided at the rear surface thereof, the gasket being mounted in a gasket mounting groove formed along an outer side of a rim portion of the rear panel.

2. The refrigerator according to claim 1, wherein the basket holder includes a pair of basket holders fastened by screws into a pair of mounting recesses provided near opposite vertical edges of the rear surface of the door liner.

3. The refrigerator according to claim 2, wherein the basket includes a pair of insertion recesses for insertion of a pair of protrusions of the respective pair of basket holders, wherein each of the pair of insertion recesses is provided at opposite sides of a lower portion of a rear surface of the basket.

4. The refrigerator according to claim 3, wherein each of the pair of protrusions has an inwardly bent shape at a distal end thereof.

5. The refrigerator according to claim 4, wherein each of the pair of insertion recesses includes a cover portion configured to prevent the protrusion inserted therein from being separated in the horizontal direction.

6. The refrigerator according to claim 3, wherein the basket further includes a support having two ends inserted into and mounted in a pair of holes formed in upper corners of the insertion recesses, the support being provided along a rim of an upper surface of the basket.

7. The refrigerator according to claim 2, wherein the door liner further includes a bush provided on the rear surface thereof, the bush being fastened with a screw having passed through a fastening hole of the basket holder and a through-hole formed in the mounting recess.

8. The refrigerator according to claim 7, wherein an insulation material is provided in a space between the door liner and the outer door.

9. The refrigerator according to claim 1, wherein the rear panel includes a bent portion that extends from a rim of the through-hole.

10. The refrigerator according to claim 9, wherein the basket holder includes a receiving groove formed in a front surface thereof around the protrusion, and wherein the bent portion of the tear panel is inserted into the receiving groove.

11. The refrigerator according to claim 10, wherein the rear panel is a plated steel panel.

12. A refrigerator comprising:

a cabinet;

a first door to allow access to a storage compartment within the cabinet; and a second door to allow access to a space provided between the first door and the second door, wherein the second door includes:

a front surface, a door liner coupled to a rear surface of the second door, a pair of basket holders mounted in a pair of respective mounting recesses provided in the door liner, each of the pair of basket holders having a protrusion, a rear panel attached to a rear surface of the door liner, the rear panel having a through-holes configured to allow passage of the protrusions, and a basket mounted to the protrusions of the pair of basket holders.

13. The refrigerator according to claim 12, wherein the pair of basket holders are fastened by screws into the pair of mounting recesses, which are provided near opposite vertical edges of the rear surface of the door liner.

14. The refrigerator according to claim 12, wherein the basket includes a pair of insertion recesses for insertion of the protrusions of the respective pair of basket holders, wherein each of the pair of insertion recesses is provided at opposite sides of a lower portion of a rear surface of the basket.

15. The refrigerator according to claim 14, wherein the basket further includes a support having two ends inserted into and mounted in a pair of holes formed in upper corners of the insertion recesses, the support being provided along a rim of an upper surface of the basket.

16. The refrigerator according to claim 14, wherein the protrusions have a bent shape at a distal end thereof.

17. The refrigerator according to claim 16, wherein each of the pair of insertion recesses includes a cover portion to prevent the protrusion inserted therein from being separated in the horizontal direction.

18. A refrigerator comprising:

a cabinet;

a door pivotably mounted to the cabinet; and at least one basket configured to be mounted to a rear surface of the door, wherein the door includes:

an outer door defining a front surface of the door;

a door liner coupled to a rear surface of the outer door;

at least one basket holder including a protrusion to mount the basket in at least one mounting recess provided in the door liner and a receiving groove formed around the protrusion; and a rear panel attached to a rear surface of the door liner, wherein the rear panel is provided with a through-hole for the protrusion to pass through having a bent portion that extends from a rim of the through-hole, wherein, the bent portion is inserted into the receiving groove.

19. The refrigerator according to claim 18, wherein the door liner includes a bush provided on the rear surface thereof, the bush being fastened with a screw having passed through a fastening hole of the at least one basket holder and a through-hole formed in the mounting recess.

* * * * *